United States Patent [19]

Porowski

[11] Patent Number: 4,662,434

[45] Date of Patent: May 5, 1987

[54] VIBRATION FREE TUBULAR APPARATUS AND PROCESS FOR MAKING SAME

[75] Inventor: Jan S. Porowski, Pittsburgh, Pa.

[73] Assignee: O'Donnell & Associates, Inc., Pittsburgh, Pa.

[21] Appl. No.: 744,049

[22] Filed: Jun. 12, 1985

[51] Int. Cl.[4] ..... F28F 7/00

[52] U.S. Cl. ..... 165/69; 165/162; 29/157.3 V

[58] Field of Search ..... 165/69, 162; 29/157.3 V

[56] References Cited

U.S. PATENT DOCUMENTS

| | | | |
|---|---|---|---|
| 3,163,208 | 12/1964 | Cuzzone et al. | 165/69 |
| 3,199,582 | 8/1965 | Vogt et al. | 165/69 |
| 3,864,811 | 2/1975 | Walker | 165/162 |

FOREIGN PATENT DOCUMENTS

| | | | |
|---|---|---|---|
| 2052837 | 4/1972 | Fed. Rep. of Germany | 165/69 |
| 339751 | 1/1968 | U.S.S.R. | 165/DIG. 1 |

*Primary Examiner*—Albert W. Davis, Jr.
*Assistant Examiner*—Peggy A. Neils
*Attorney, Agent, or Firm*—Joseph J. Carducci

[57] ABSTRACT

A novel apparatus comprising a plurality of parallel, spaced apart tubes and an expanded closed, flattened, elongated tube extending laterally between the spaced apart tubes and in firm contact with them. The novel process comprises inserting the closed, flattened elongated tube laterally between the spaced apart tubes and then expanding the elongated tube until it comes into firm engagement with the spaced apart tubes.

2 Claims, 9 Drawing Figures

VIBRATION FREE TUBULAR APPARATUS AND PROCESS FOR MAKING SAME

FIELD OF THE INVENTION

This invention relates to the tubular apparatus substantially free of vibration and process for making a tubular apparatus substantially free of vibration.

BACKGROUND OF THE INVENTION

It is known that tubes in a tubular assembly, such as heat exchangers, for example, steam generators, often vibrate due to flow of fluid between the individual tubes. In order to reduce the free span of the individual tubes, and thus their tendency to vibrate, baffles and solid bars have been used. However, in order to assemble the tubes, tolerances must be permitted within the openings in the baffles and between the individual bars. Therefore, wear often occurs due to whirling or rattling of the tubes in the baffle openings or between the bars, thereby reducing the wall thicknesses of the tubes and giving rise to possible breaks in the walls.

SUMMARY OF THE INVENTION

I have devised a tubular apparatus that is easy to make and that is substantially free of any tendency whatsoever to vibrate, as well as a process for obtaining the same.

The novel apparatus herein comprises an assembly comprised of a plurality of parallel, spaced apart tubes having a regular annular cross section and at least one closed, flattened, elongated metal tube having an opening therein, that communicates from the exterior of said elongated metal tube to the interior of said elongated metal tube, disposed laterally between said plurality of tubes, said elongated metal tube being in direct contact with each adjacent tube of said plurality of tubes, the portion of said elongated metal tube in contact with said adjacent tube being recessed to receive the portion of said adjacent tube in contact therewith.

The novel process for preparing the novel apparatus defined and claimed herein is intended to reduce, and substantially, eliminate, vibration between adjacent tubes in an assembly comprised of a plurality of parallel, spaced apart tubes having a regular annular cross section which comprises in placing at least one closed; flattened, elongated metal tube, having an opening therein that communicates from the exterior of said elongated metal tube to the interior of said elongated metal tube, laterally between said plurality of tubes and then applying pressure to the interior of said elongated metal tube to inflate said elongated metal tube outwardly until contact is made with an adjacent tube in said assembly and a recess is formed in the wall of said elongated metal tube to receive the portion of said adjacent tube in contact therewith.

DETAILED DESCRIPTION OF THE DRAWINGS

Figure 1:
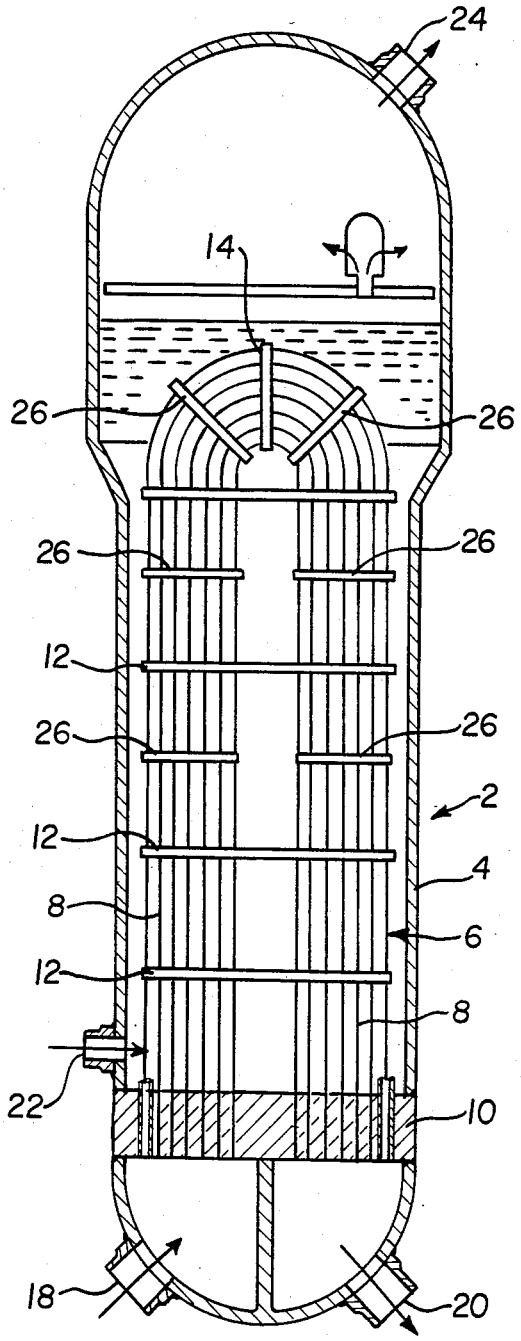
FIG. 1 is a cross section of an assembly of pipes disposed in a steam generator.
Figure 2:
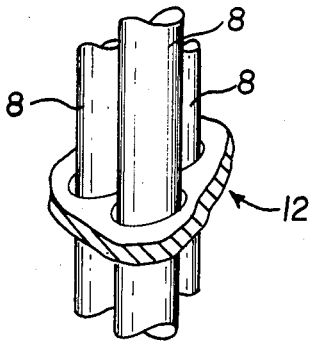
FIG. 2 is a partial perspective of a perforated support plate.
Figure 3:
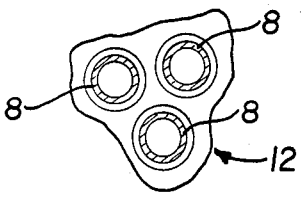
FIG. 3 is a top view of the perforated support plate of FIG. 2.
Figure 4:
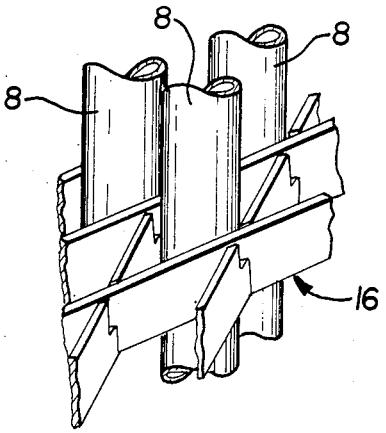
FIG. 4 is a partial perspective of a support crate.
Figure 5:
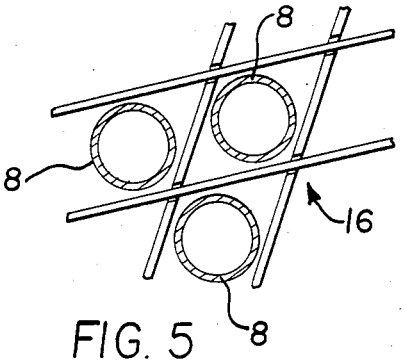
FIG. 5 is a top view of the support crate of FIG. 4.
Figure 6:
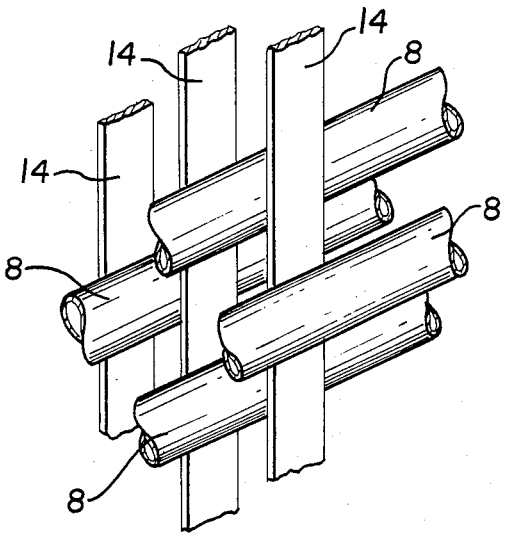
FIG. 6 is a partial perspective of individual solid antivibration bars that have been used commercially.

FIG. 1 illustrates a conventional steam generator 2 composed of an outer shell 4 that encloses a tube bundle 6 composed of individual U-shaped tubes 8 attached to tube sheet 10. Each of tubes 8 is disposed parallel to the other individual tubes in the bundle and each tube has a regular annular crosssection. Also shown therein are support plates 12 and solid antivibration bars 14 that have been used heretofor as antivibration devices. Support plates 12 can better be shown in FIGS. 2 and 3. In place of support plates 12, support crates 16 as shown in FIGS. 4 and 5, can be used. Solid antivibration bars 14 can be better seen in FIG. 6. As pointed out hereinabove, each of these devices has been used in the past to reduce antivibration in a tube assembly but with partial success.

Operation of steam generator 2 is conventional. Thus, hot water enters the system through nozzle 18 rises upwardly through tubes 8 and leaves the steam generator somewhat cooler through nozzle 20. Feedwater enters the system through nozzle 22, is heated by water circulating in tubes 8 and exits as steam through nozzle 24.

Figure 7:
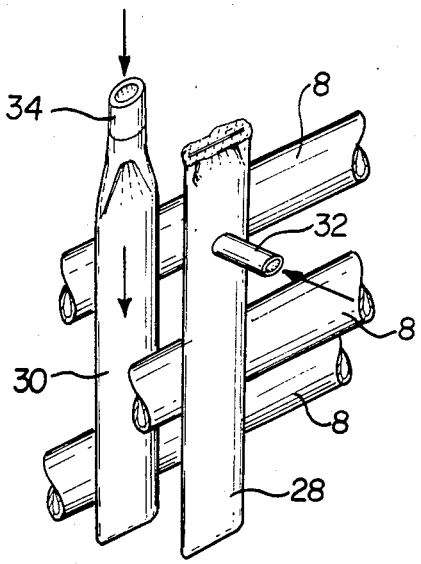
FIG. 7 is a partial perspective of closed flattened, elongated tubes used herein before thay have been inflated.

The closed, flattened, elongated metal tubes used herein as antivibration devices are shown in FIG. 1 by reference numeral 26. These metal tubes can be made of any suitable metal, such as Type 304 stainless steel. Two forms 28 and 30 are illustrated in FIG. 7. Metal tube 28 is essentially a flattened metal pipe welded at each end thereof to close the same and is provided in one of its walls with a nozzle 32 communicating from the exterior thereof into its interior. Preferably nozzle 32 provides merely an opening for injecting a fluid, such as water, into the interior of the elongated metal tube, using any conventional means. Pipe 30 is somewhat similar to pipe 28, except that it is closed at its lower end by welding and has a nozzle 34 disposed at its elongated other end. While I have defined my antivibration device used herein as a closed, flattened, elongated tube, and I have shown in the preferred embodiments in FIG. 7 the same to be in the form of an elongated tube, it is my intention to include by such definition any such or similar configuration, however it may have been made. Thus, the closed, flattened, elongated tube used herein as an antivibration device can also be made, for example, by placing two flat, elongated metal plates facing each other, welding the outer edges thereof to form an envelope and then providing a wall thereof with an opening so that a fluid, such as water, can be pumped therein to inflate the same.

Figure 8:
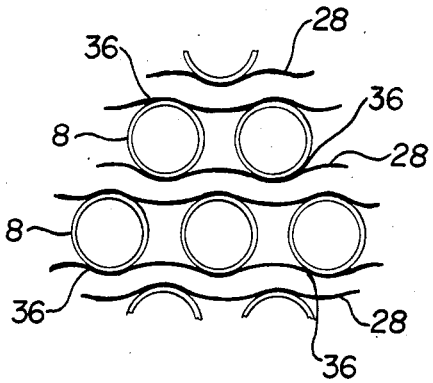
FIG. 8 is a tube bundle cross-section after the closed flattened, elongated tubes used herein have been inflated. The tubes in the tube bundle have been arranged in a triangular pattern.
Figure 9:
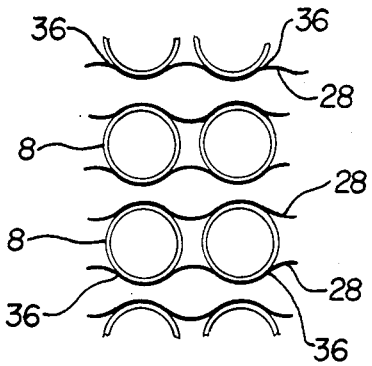
FIG. 9 is similar to FIG. 8, except that the tubes in the bundle have been arranged in a square pattern.

In carrying out the process defined and claimed herein, one or more antivibration devices, for example, such as those shown in FIG. 7, are placed or disposed laterally and between tubes 8, again as shown in FIG. 7. A tube carrying a suitable fluid, preferably water, is attached to nozzle 32 and/or 34, and water is forced under pressure into the interior of the closed, elongated flattened tube until the flattened tube is inflated. As shown in FIGS. 8 and 9, as the elongated flattened tube is inflated, its wall will expand outwardly and will contact an adjacent tube 8. Continued expansion of the elongated, flattened tube will result in the formation of a recess 36 therein in which the adjacent pipe 8 will be received. Since the application of pressure will result in permanent deformation of the elongated metal tube, the pressure thereon can then be terminated. It is apparent, therefore, that the pipes in the tube assembly will be firmly held in place, because they are always in contact with the elongated, flattened tube within the recesses thereof.

In a typical steam generator wherein the antivibration device herein can be employed, the tube bundle can be comprised of several thousand U-shaped tubes composed of high nickel alloy, for example, an Inconel-type, each tube being about 48 feet long and having an outside diameter of about 0.75 inch. The tubes are substantially uniformly spaced from each other a distance of about one inch. The antivibration bars, in a typical situation, before expansion will have a thickness of about 0.090 inch, a width about two inches and a length of about six feet.

Obviously many modifications and variations of the invention, as hereinabove set forth, can be made, without departing from the spirit and scope thereof, and therefore, only such limitations should be imposed as are indicated in the appended claims.

I claim:

1. A novel apparatus comprising an assembly comprised of a plurality of parallel, spaced apart tubes having a regular annular cross-section and at least one closed, flattened, permanently deformed, elongated metal tube having an opening therein, that communicates from the exterior of said elongated metal tube to the interior of said elongated metal tube for introduction of a fluid into the interior of said elongated metal tube for the purpose of inflating said elongated metal tube, disposed laterally between said plurality of tubes, said elongated metal tube being in direct contact with each adjacent tube of said plurality of tubes, the portion of said elongated metal tube in contact with said adjacent tube being permanently recessed to receive the portion of said adjacent tube in contact therewith.

2. The apparatus of claim 1 in which said apparatus comprises a tube bundle mounted in a heat exchanger.

* * * * *